US008430663B2

(12) United States Patent
Boegli

(10) Patent No.: US 8,430,663 B2
(45) Date of Patent: Apr. 30, 2013

(54) DEVICE FOR SATINIZING AND EMBOSSING PACKAGING FOILS

(75) Inventor: Charles Boegli, Marin (CH)

(73) Assignee: Boegli-Gravures S.A., Marin (CH)

( * ) Notice: Subject to any disclaimer, the term of this patent is extended or adjusted under 35 U.S.C. 154(b) by 615 days.

(21) Appl. No.: 11/933,892

(22) Filed: Nov. 1, 2007

(65) Prior Publication Data

US 2008/0116610 A1 May 22, 2008

(30) Foreign Application Priority Data

Nov. 22, 2006 (EP) ..... 06405487

(51) Int. Cl.
*B31F 1/07* (2006.01)

(52) U.S. Cl.
USPC ..... 425/369; 425/335; 264/284

(58) Field of Classification Search ..... 425/363, 425/335, 336, 369; 101/6; 264/284
See application file for complete search history.

(56) References Cited

U.S. PATENT DOCUMENTS

| | | | | |
|---|---|---|---|---|
| 1,954,635 | A | 4/1934 | Leonard, Jr. | |
| 3,130,412 | A * | 4/1964 | Fox et al. | 428/179 |
| 3,673,839 | A * | 7/1972 | Nielsen et al. | 72/196 |
| 4,361,085 | A * | 11/1982 | Schutz | 101/23 |
| 6,715,411 | B1 | 4/2004 | Boegli | |
| 7,036,347 | B2 | 5/2006 | Boegli | |
| 7,147,453 | B2 | 12/2006 | Boegli | |
| 7,229,681 | B2 | 6/2007 | Boegli | |
| 2003/0075262 | A1 * | 4/2003 | Hein et al. | 156/209 |
| 2004/0109911 | A1 * | 6/2004 | Boegli | 425/363 |
| 2004/0151796 | A1 * | 8/2004 | Boegli | 425/364 R |

FOREIGN PATENT DOCUMENTS

| | | |
|---|---|---|
| EP | 1 437 213 A1 | 7/2004 |
| FR | 1 264 268 | 6/1961 |
| GB | 18668 | 4/1911 |
| WO | WO 02/076716 A | 10/2002 |

* cited by examiner

*Primary Examiner* — Galen Hauth
(74) *Attorney, Agent, or Firm* — Foley & Lardner LLP

(57) ABSTRACT

The device for satinizing and embossing metallized or surface-treated packaging foils comprises three embossing rolls, all three embossing rolls cooperating with one another and the packaging foil being capable of being passed under pressure between the first and the second and between the first and the third embossing rolls in order to produce a satin-finish and a pattern. The first, driven embossing roll has a tooth array composed of individual teeth that are arranged in a homogenous grid, and the other two embossing rolls each have a surface structure that differs from that of the first embossing roll. At least one of the additional embossing rolls has structural elements that are arranged individually or in groups but not in the same grid as on the first roll, the structural element being composed of individual teeth and being arranged circularly on the embossing roll. Such an arrangement provides an effective breaking of the paper substrate of the foil and thus a surface having improved properties. Such a surface is particularly suitable for shadow embossing and for embossing authentication and identification features.

19 Claims, 6 Drawing Sheets

R2B

R3S

R2G

R3X

DEVICE FOR SATINIZING AND EMBOSSING PACKAGING FOILS

BACKGROUND OF THE INVENTION

The present invention refers to a device for satinizing and embossing packaging foils, comprising a first, a second, and a third embossing roll, the first embossing roll being in rolling contact with each of the second or third embossing rolls and the packaging foil being capable of being passed under pressure between the first and the second and between the first and the third embossing rolls in order to produce a satin-finish and a pattern, the first embossing roll having a tooth array arranged in a basic grid and composed of homogenously arranged individual teeth, and the other two embossing rolls having a surface structure that differs from that of the first embossing roll.

However, it is also possible to use a device for satinizing and embossing packaging foils, comprising a first and a second embossing roll, the two embossing rolls being in rolling contact with one another and the packaging foil being capable of being passed under pressure between the first and the second embossing rolls in order to produce a satin-finish and a pattern, the first embossing roll having a tooth array arranged in a basic grid and composed of homogenously arranged individual teeth, and the other embossing roll having a surface structure that differs from that of the first embossing roll.

Devices of this kind are known from U.S. Pat. No. 7,147,453 to the applicant of the present invention. This patent is a further development of the device according to U.S. Pat. No. 6,715,411 to the same applicant. The two devices defined therein have in common that the paper web first passes through a first roll pair and then through a second roll pair, the application of three rolls allowing to reduce the contact pressure and to achieve an improved breaking of the paper component of the foil.

The surface structures of the embossing rolls, i.e. the arrangements of teeth, circular ridges, or longitudinal ridges on the known rolls, break the paper symmetrically, whereby, as compared to the previously known state of the art, a more homogenous breaking of the fibers in two directions and finer embossing patterns can be achieved, wrinkling in the logo area is avoided, a reduced tendency to tubing and curling is observed, and a good fold capacity, or a so-called dead fold capacity, can be achieved.

Recently, however, further problems have been encountered with foils on a paper substrate. Some of these problem areas resulting from the various new paper properties are indicated below:

a) An influential factor that is difficult to control is the inconsistency regarding the composition of the foil, or inner liner, as it is called in the cigarette industry, the difficulties residing in the fact that the diversity of commercially available inner liner papers is continuously increasing without any standardization tendencies being apparent. This means that depending on the region or the requirements from the marketing sector, papers having a specific surface weight of 30 $g/m^2$ to 80 $g/m^2$ are being used which are metallized, aluminum coated or surface-treated, e.g. by printing, to obtain a metal-like surface. In the application of so-called shadow embossings, see e.g. U.S. Pat. No. 7,036,347 to the applicant of the present invention, very fine structures are produced which have to be embossed with constant quality independently of the material.

b) The mechanical properties of the foils are largely determined by the pulp fibers that are used, by their morphological properties, and the way they are processed. Outwardly similar foils may therefore strongly differ in their mechanical behavior. For these reasons, it is desirable to achieve good results with inner liners of poor quality.

c) For the industrial embossing of the different foils it is therefore desirable to become more independent from their large sensitivity range.

d) Another, economical challenge consists in embossing foils of different compositions in such a manner that they hardly differ from each other optically any more when contemplating similarly embossed marks. In the current state of the art, depending on the composition of the foil, the same embossing patterns, both in logos and in shadow embossings, may look very different to the eye.

SUMMARY OF THE INVENTION

On the background of this prior art, it is the object of the present invention to provide a device for satinizing and embossing foils by means of which the fibers of the paper substrate of the foil are broken even more effectively in order to yield an improved overall esthetical impression after the embossing procedure that is substantially independent from the composition of the paper substrate of the foil and to allow a perfect embossing of fine structures.

This is accomplished by a device wherein at least one of the other two embossing rolls has a surface structure with structural elements that are arranged individually or in groups but not in the same basic grid as on the first embossing roll, each structural element consisting of individual teeth or of a continuously formed ridge or of a combination of these two configurations, and the structural elements being arranged circularly, longitudinally, or helically on the second and/or third embossing roll.

This is also accomplished by a device wherein the second embossing roll has a surface structure with structural elements that are arranged individually or in groups but not in the same basic grid as on the first embossing roll, each structural element consisting of individual teeth or of a continuously formed ridge or of a combination of these two configurations, and the structural elements being arranged circularly, longitudinally, or helically on the second embossing roll.

Further objects and advantages are defined in the dependent claims.

BRIEF DESCRIPTION OF THE DRAWINGS

The invention will be explained in more detail hereinafter with reference to drawings of exemplary embodiments.

DESCRIPTION OF SOME EMBODIMENTS

Figure 1:
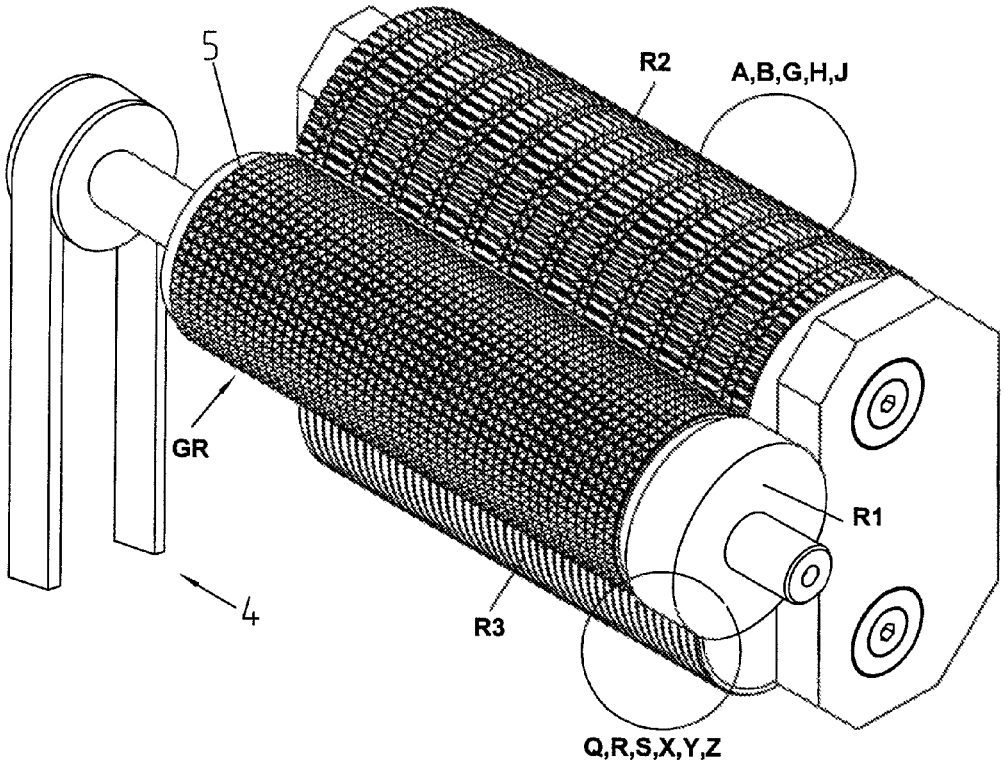
FIG. 1 shows, schematically and in a perspective view, a device with an embossing roll having a homogenous arrangement of teeth that cooperates with two additional embossing rolls, FIGS. 2 to 5 each show respective structures of the two additional embossing rolls in a detail enlargement.

In the schematic illustration of FIG. 1, three embossing rolls R1, R3, and R2 are shown, embossing roll R1 being driven by a drive 4. Embossing roll R1 is known per se and has been disclosed in different patent specifications as well as in the references cited in the introduction. Driven embossing roll R1 has a surface structure formed of individual teeth 5 that are arranged in a both axially and circularly homogenous grid pattern and by which the satin finish is achieved. This surface structure is called the basic grid GR. The teeth of the latter may be pyramidal with different cross-sections, frustopyramidal, or conical in shape. In the case of pyramidal teeth, the latter have a cross-section in the shape of a tetragonal parallelogram.

Figure 9:
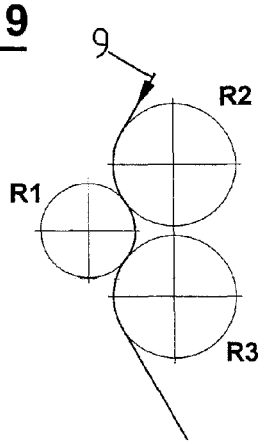
Figure 10:
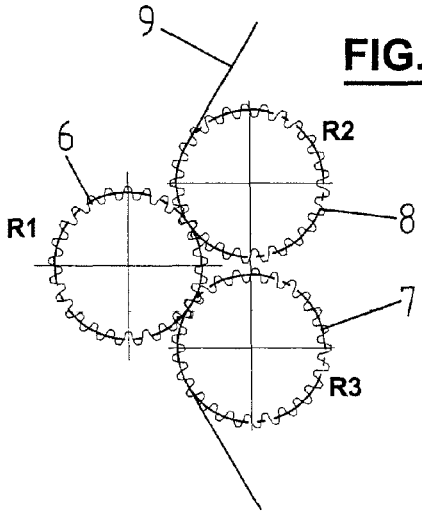

The two additional embossing rolls R2 and R3 may be driven via foil 9 and by means of suitable surface structures by first embossing roll R1, see FIG. 9, or by means of a synchronizing gear 6, 7, and 8 of a type known in the art per se, see FIG. 10. Generally, foil 9 is passed through the embossing rolls in such a manner that the metallized or treated surface is facing first embossing roll R1.

However, it is also possible to drive embossing roll 2 or 3 rather than embossing roll 1 and to let the other embossing rolls run freely. Instead of a synchronization by means of gearwheels, a synchronization by means of belts or electronic means is also possible.

In the manufacture of paper, the so-called flocculation is a key process that consists in that fibrous suspensions have a natural tendency to flaking. The latter increases with the fiber concentration, thereby resulting in an increasing stock consistency. The dense fiber flocculation observed in may inner liners results confers the paper a relatively high rigidity. However, the flakes are distributed over the paper surface very irregularly, and a homogenous, fine sieve structure cannot be achieved.

Studies have shown that with a uniform tooth array, the foil tends to be shortened in the traveling direction, i.e. in the longitudinal direction, and to be slightly widened in the transversal direction during the embossing operation. This effect may be explained by the fact that the pulp fibers are mainly aligned in the longitudinal direction. As the fibers are crushed, they naturally increase in width and only little in length.

To counteract this tendency, according to the prior art, the surface of each embossing roll was provided with elevations and impressions of the same kind, i.e. with the basic grid, e.g. with pyramidal teeth of different cross-sections such as tetragonal parallelograms, truncated pyramids, or conical teeth, thereby allowing an interaction with other embossing rolls involved in the embossing process.

Asymmetrical structural elements in the basic grids composed of identical teeth were avoided in order to counteract a distortion of the embossing pattern. Recently, different alternatives have been examined to cope with the requirements brought about by the different paper types and qualities.

Tests have now shown that by using embossing rolls provided with different structural elements such as toothed crowns, tooth rows that are circularly, helically, or longitudinally arranged along the embossing roll and whose grid is not the same as the basic grid GR of the first embossing roll, a very important improvement of the breaking action, respectively of the neutralization of the substructures created in the paper substrate by flocculation could be achieved. This may be explained by the fact that structures of the roll surface which do not have the same basic grid GR are more suitable for eliminating accidentally formed flakes. This applies both to the three-roll and to the two-roll arrangement.

With the use of the rolls described below, not only a better breaking and neutralization of the paper substrate with regard to wrinkling, tubing and curling is achieved, but particularly also an esthetically significantly improved foil surface that confers the latter a precious appearance. Ultimately, such a foil surface allows a finer and more precise embossing of very fine structures which serve e.g. for producing authentication and identification features.

As seen in FIG. 9 or 10, foil 9 first passes through roll pair R1 and R2 and subsequently through roll pair R1 and R3. It follows that the foil first passes through the arrangement of different structures of one of the roll pairs and is subsequently treated in another manner, i.e. inhomogeneously, by the surface structure of the second roll pair assembly, thereby resulting in an altogether inhomogeneous treatment of the foil that produces surprising results.

In FIG. 1, as already mentioned in the introduction, embossing roll R1 is provided with homogenously arranged individual teeth 5 defining the basic grid GR. The latter may be pyramidal or conical teeth having a flattening of at least 2%, preferably at least 5%, the cross-section of the pyramidal teeth having the shape of a tetragonal parallelogram.

Furthermore, in FIG. 1, the surface structures of embossing rolls R2 and R3 are symbolized by letters A to J and Q to Z, respectively. Upon comparison of FIG. 1 to FIG. 2 it is apparent that the designation R2A denotes surface structure A of embossing roll R2, and R3Q the surface structure Q provided on embossing roll R3, etc.

Figure 2:
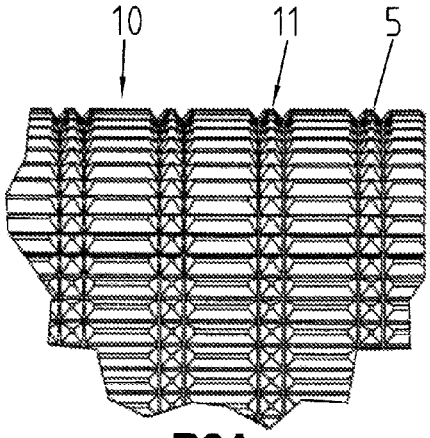
Figure 2:
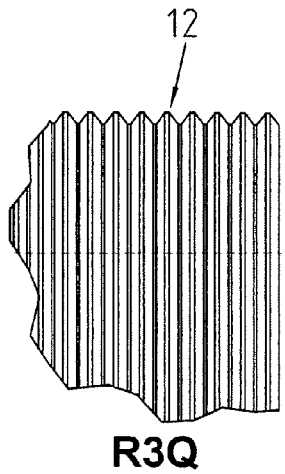

In FIG. 2, possible surface structures of embossing rolls R2 and R3 are depicted. Surface structure A of the roll surface of R2 according to FIG. 2 is defined by longitudinal ridges 10 that are interrupted by individual structural elements in the form of tooth rows 11, tooth row 11 being composed of individual teeth 5 and the teeth in the present example having a frustopyramidal shape. Therefore, instead of uniform longitudinal ridges as they are known from the prior art, the surface of R2 consists of longitudinal ridges that are interrupted by circular tooth rows while the grid of these structural elements is not the same as basic grid GR.

Here, the structure Q of third embossing roll R3 consists of uniformly arranged circular ridges 12 in a manner known per se in embossing rolls of the prior art.

In cross-section, the longitudinally, transversally, or helically arranged structural elements are outwardly tapered and flattened, the dimensions of the structural elements and of the grooves therebetween corresponding to the dimensions of teeth 5 of the first, driven embossing roll R1, and all teeth engaging in the grooves between the ridges.

Figure 3:
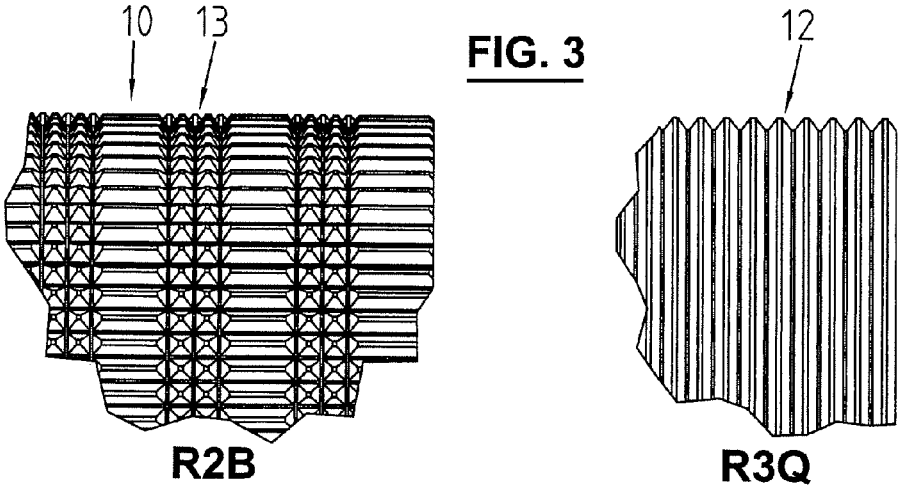

In FIG. 3 it is shown that surface structure B of embossing roll R2 comprises the interrupted longitudinal ridges 10 as well as double tooth rows 13, while it is understood that three or more tooth rows interrupting longitudinal ridges 10 may be provided. Embossing roll R3 has the same surface structure Q as in FIG. 2.

Figure 4:
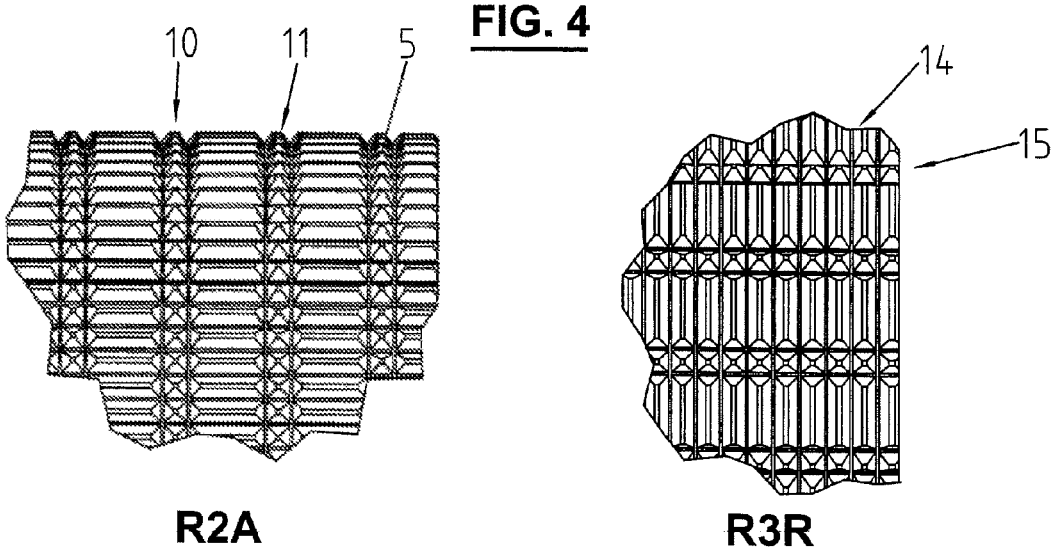

In FIG. 4 it is shown that embossing roll R2 has the same surface structure A as in FIG. 2 while embossing roll R3 has a surface structure R in which circular ridges 14 are interrupted by longitudinally arranged tooth rows 15, the latter being composed of individual teeth 5.

Figure 5:
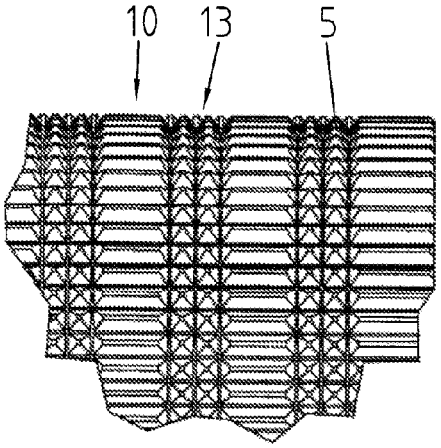
Figure 5:
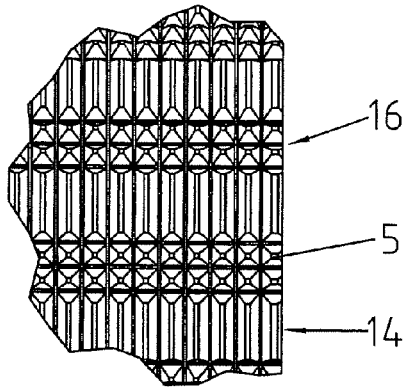

In the illustration of FIG. 5, embossing roll R2 has the same surface structure B as in FIG. 3 while embossing roll R3 has a surface structure S where circular ridges 14 are interrupted by double longitudinal rows 16, the latter again being composed of individual teeth 5.

The description of FIGS. 1 to 5 already shows that a large diversity of variations is conceivable. Thus, it is of course possible not only to provide structural elements in the form of single or double rows of teeth, but also triple or multiple rows of individual teeth between which longitudinal or circular ridges are arranged.

Furthermore it will be appreciated that both the dimensions of the individual teeth and the distances between the tooth rows may vary, as well as the dimensions and distances of the longitudinal or circular ridges, provided that they are dimensioned and arranged so as to always interlock with or roll off on the grid of teeth of embossing roll R1. It is understood that any desired combination of the indicated roll types of both embossing rolls is possible.

Figure 6:
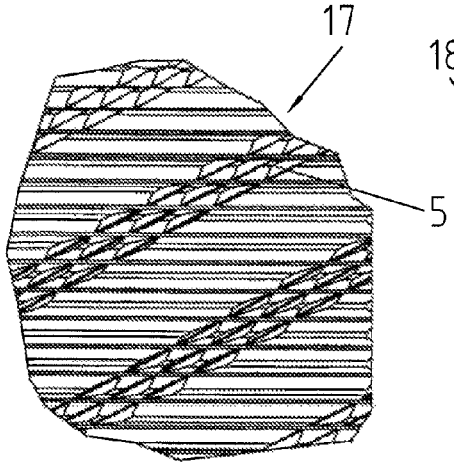
FIG. 6 shows an embodiment variant of the structures of the additional embossing rolls.
Figure 6:
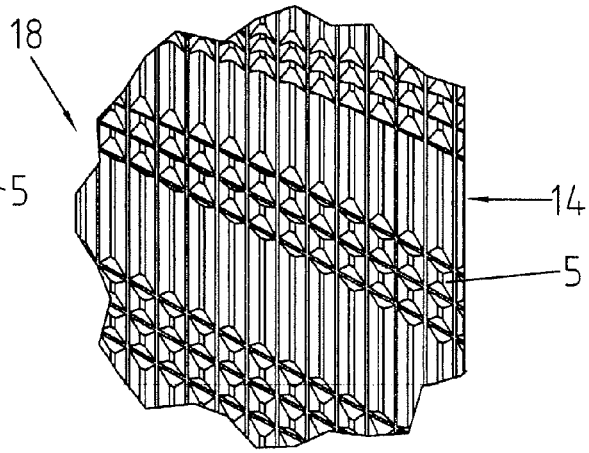
Figure 8:
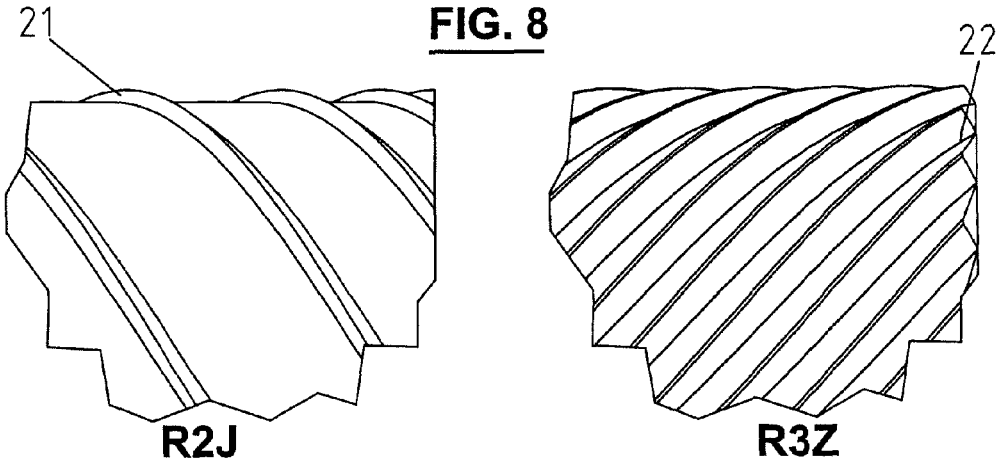

Whereas FIGS. 1 to 5 illustrate surface structures in which the structural elements or arranged orthogonally to the longitudinal axis of the rolls, FIGS. 6 and 8 illustrate surface structures in which the structural elements formed of individual teeth or of continuous ridges are arranged helically.

In FIG. 6, a surface structure G is shown for embossing roll R2 in which structural elements 17 are helically arranged in the same longitudinal ridges 10 as in FIG. 5, e.g. at an angle of 45° with respect to the longitudinal axis, these elements being again composed of tooth rows comprising individual teeth 5.

Mating roll R3 has a surface structure X whose configuration is the mirror image of structure G while structural elements 18 formed of two rows of teeth 5 and arranged at an angle of e.g. 45° with respect to the longitudinal axis of the embossing roll are provided, however. As shown in FIGS. 3, 4, and 5, embossing roll R3 with surface structure X is also provided with rings 12 that are interrupted by structural elements 18.

Figure 7:
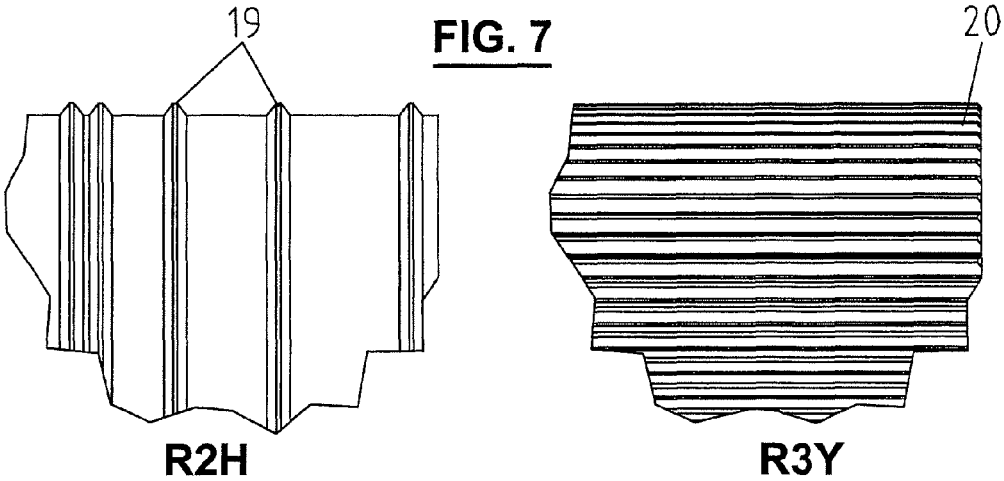
FIGS. 7 and 8 show further embodiment variants of the structures of the additional embossing rolls, FIG. 9 schematically shows a cross-section of the three unsynchronized embossing rolls, FIG. 10 schematically shows a cross-section of the three synchronized embossing rolls.

In FIG. 7, a surface structure H is illustrated for embossing rolls R2 whose structural elements are not composed of rows of individual teeth but of circular ridges 19, the distances between the individual ridges being variable, and no longitudinal ridges being provided. Embossing roll R3 has the surface structure Y that is composed of longitudinal ridges 20. Here also, the cooperation of embossing rolls R2 and R3 results in a non-homogenous breaking of the paper fibers.

Embossing rolls according to FIG. 8 can be regarded as being analogous to the embossing rolls according to FIG. 6 in that helically arranged ridges 21 are provided as the structural elements, however without intermediate longitudinal or transversal ridges. The distances between the individual ridges may again be variable. In this example, ridges 22 of embossing roll R3 forming the surface structure Z are helically arranged next to one another. Here also, the interaction of the two embossing rolls R2 and R3 results in a non-homogenous embossing action and thus in a maximum breaking action of the paper fibers.

Based on these exemplary embodiments, a very large number of variations are possible, both with regard to the distances between the individual paths and to the angle of the circumferential paths. Combinations of the depicted types are also possible, i.e. individual circular, longitudinal or helical paths may be composed of individual teeth. Furthermore it is apparent to one skilled in the art that the teeth need not necessarily be rectangular or square pyramids that are flattened at their tips but may also be conical, preferably flattened teeth.

Figure 14:
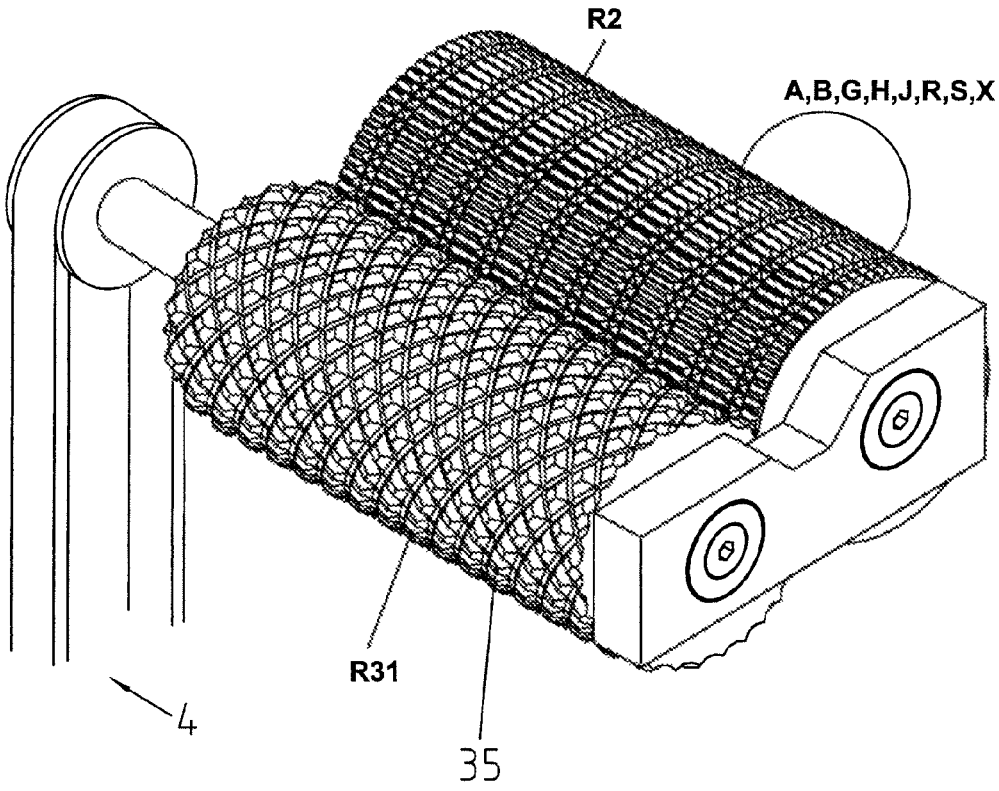
FIG. 14 shows a second embodiment of the invention having two embossing rolls.

For certain paper types it is sufficient to use only a two-roll device according to FIG. 14. Correspondingly, all the previously described surface structures also apply to the two-roll device, driven embossing roll R31 having a basic grid GR1 that is analogous to basic grid GR. As an embodiment variant, teeth 35 have a rhombic cross-section where the sides can be arranged at a desired angle with respect to the longitudinal axis, e.g. turned by 45°. In this manner, a good synchronization of the two rolls is achieved.

The second roll R2 is always provided with a non-homogenous surface structure, e.g. according to A, B, G, H, J; R, S, X. If the first embossing roll has a tooth array as that of R1, the second roll may be driven either through the shape of the teeth and ridges via the foil, or via synchronizing means.

In the represented form, the described and illustrated embossing rolls are suitable for an optimal satinizing of packaging foils, more particularly of cigarette papers. If logos are desired, they are preferably provided as known from the prior art on embossing roll R1 provided with basic grid GR or GR1. This is accomplished by removing teeth at the location where the logo is to appear, so that the metallized or treated surface of the foil that comes to lie on this location will not be altered during its passage and remains glossy.

As mentioned in the introduction already, a particularly fine surface of the foil is obtained with the treatment of to the invention so that in addition to logos, authentication and identification features that are particularly fraud resistant and have very fine structures may be embossed. Furthermore, this surface structure is also particularly suitable for so-called shadow embossing, which will be described below.

Authentication and identification features and shadow embossings may e.g. be produced according to U.S. Pat. No. 7,036,347 to the applicant of the present invention or by means of embossing rolls as disclosed in EP-A-1 437 213 to the same applicant.

Figure 11:
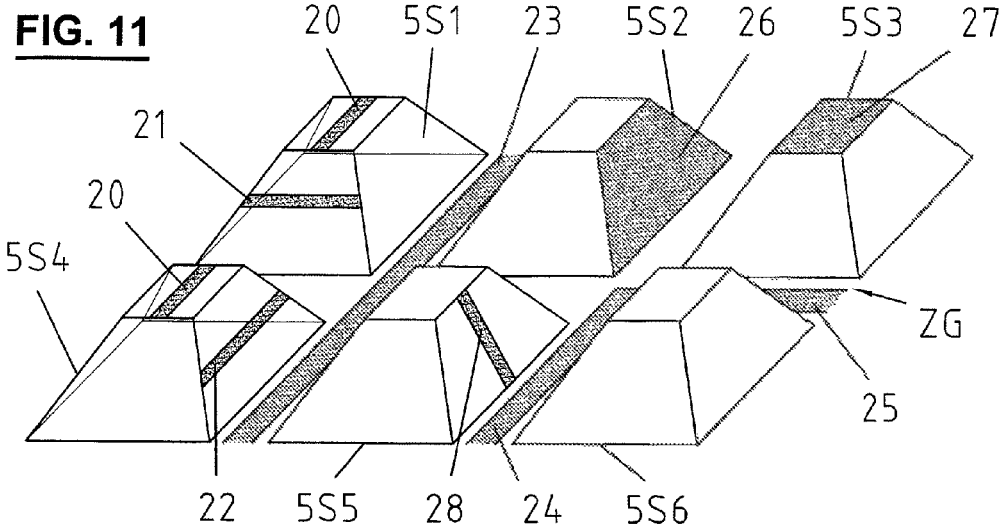
FIG. 11 shows a detail enlargement of teeth of the first embossing roll that are provided with macro- and microstructures.
Figure 12:
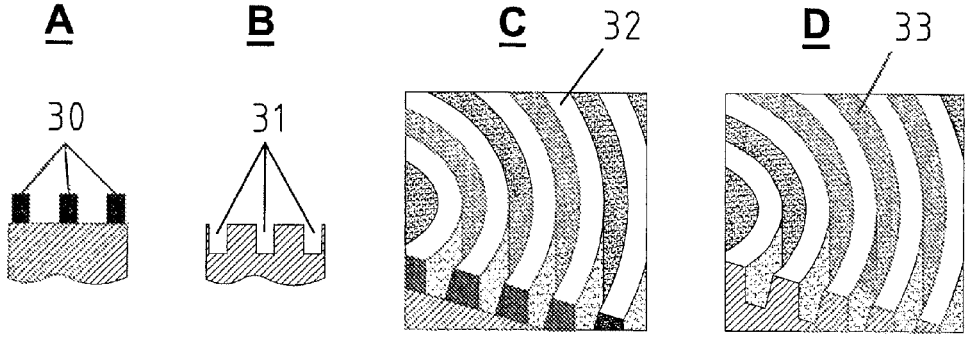
FIG. 12 shows different possible microstructures of the tooth surface of FIG. 11 on a further enlarged scale.
Figure 13:
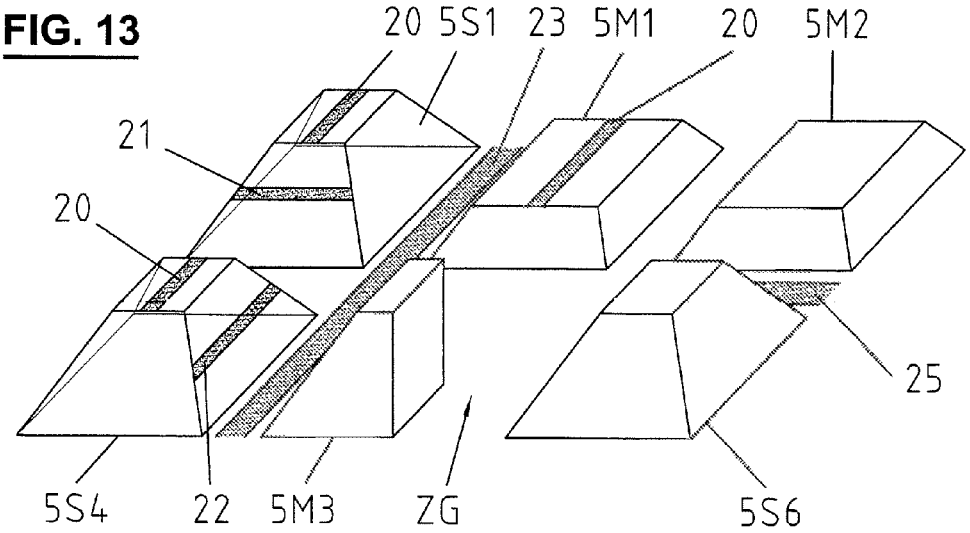
FIG. 13 shows a variant of FIG. 11 where macrostructures and microstructures are provided on the teeth.

In FIGS. 11 to 13, a surface treatment of the individual teeth and of the tooth bottom of driven embossing roll R1 that is called "macrostructure" and "microstructure" in EP-A-1 437 213 is illustrated by way of example.

In FIG. 11, six teeth 5S1 to 5S6 are depicted whose microstructures are shown hatched. The teeth are frustopyramidal with a rectangular horizontal projection, the lateral edges extending in parallel respectively perpendicularly to the longitudinal axis of the roll, and the pyramids being flattened.

Tooth 5S1 has a microstructure 20 on the flattened portion of the tooth as well as a microstructure 21 on one both transversal sides of the tooth, and tooth 5S4 has the same surface structure 20 and a microstructure 22 on one or both longitudinal side(s) of the tooth. Tooth bottom ZG may be provided with a microstructure 23 along the longitudinal side of the teeth or with a microstructure 24 extending over certain lengths or with a microstructure 25 extending transversally thereto.

Tooth 5S2 has a microstructure 26 that extends over the entire side on one or both of its longitudinal sides, and tooth 5S3 has a microstructure 27 that extends over the entire surface of its flattened portion. Teeth 5S5 only have narrow microstructures 28 extending across the height of their longitudinal sides while tooth 5S6 is unchanged. In this manner, it is understood that a large variety of microstructures can be applied, thereby creating a correspondingly large variety of patterns on the foil.

In FIGS. 12A to 12D, some examples of possible straight or curved microstructures on top and on the sides of the teeth are indicated at a larger magnification. In FIG. 12A, a cross-section of a positive grid structure is illustrated, the individual ridges 30 being arranged at intervals of some μm. This structure may be used for any one of microstructures 20, 21, 28, or 29 but may also be applied to the tooth bottom, e.g. for microstructures 23, 24, or 25.

In FIG. 12B, a cross-section of a negative grid structure is schematically indicated where recesses 31 are again arranged at intervals of some 100 nm to some μm.

In FIG. 12C, a possible positive microstructure formed of grid-like, curved ridges 32 is schematically indicated in a perspective view.

In FIG. 12D, a possible negative microstructure formed of grid-like, curved grooves 33 is schematically indicated in a perspective view. This structure is e.g. appropriate for use in microstructure 24 or 25.

It becomes apparent from these few examples that a very large range of variation both of the microstructures, respectively of the arrangement of these microstructures on the individual teeth and on the tooth bottom or only on the tooth bottom alone, and of the kind of the microstructures themselves is possible. This depends on the current state of the art with regard to the production of such structures, the production of microstructures being also applied particularly in the manufacture of electronic chips and known from this field. In such fine microstructures, the application of suitable methods such as lacquer or etching techniques plays an important role. When irradiated, such a microstructure produces a diffraction of the light.

The teeth of FIG. 13 are provided both with macrostructures and microstructures. In this regard, the term "macrostructure" is meant to designate a modification of the tooth geometry which in the embossing procedure produces marks whose appearance varies according to the viewing angle of the observer and/or the kind and/or the position of the lighting source. These geometrically modified teeth emboss the metallic surface of the foil to a greater or lesser extent. A microstructure may be superimposed on this macrostructure in order to provide the shadow embossing with special effects.

FIG. 13 illustrates three geometrically unmodified teeth 5S1, 5S4, and 5S6, however with microstructures as in FIG. 11, as well as geometrically modified teeth 5M1, 5M2, and 5M3 where the "M" stands for macrostructure. Tooth 5M1 exhibits a greater amount of flattening than a regular tooth such as 5S1, the flattened portion being provided with a microstructure 20.

Tooth 5M2 only has a larger amount of flattening and is otherwise unmodified, whereas tooth 5M3 is cut in half in its width. Of course, teeth 5M2 and 5M3 may be provided with microstructures as well. Again, in the example according to FIG. 13, the tooth bottom may be machined and may have the same microstructure 23 as in FIG. 11 and a microstructure 25.

An even greater variety of possible modifications of teeth results from the illustration of FIG. 13, thereby providing a very large variety of embossing patterns. Alternatively, only the structures on the tooth bottom may be used for embossing alone.

In this regard it should be mentioned that all teeth having macrostructures and microstructures are intended to modify the metallized or treated surface of the foil, in contrast to the tooth gaps at the location of the logos, which do not modify the surface of the foil.

It follows from the description of the surface structures of the rolls and of the macrostructures and microstructures of the teeth that the embossing rolls are made of metal.

The invention claimed is:

1. A device for satinizing and embossing packaging foils having a part made of paper, comprising:

a first embossing roll;

a second embossing roll; and a third embossing roll, the first embossing roll being in rolling contact with each of the second embossing roll or the third embossing roll and the packaging foils being capable of being passed under pressure between the first embossing roll and the second embossing roll and between the first embossing roll and the third embossing roll in order to produce a satin-finish and a pattern, the first embossing roll having a tooth array arranged in a basic grid and composed of homogenously arranged individual teeth, and each of the second embossing roll and the third embossing roll having a surface structure that differs from that of the first embossing roll, wherein:

at least one of the second embossing roll and the third embossing roll has a surface structure comprising structural elements that are arranged individually or in groups but not in the same basic grid as on the first embossing roll, each of the structural elements of the at least one of the second embossing roll and the third embossing roll includes individual teeth or a combination of teeth and a continuously formed ridge, at least one of the teeth and the ridge of the at least one of the second embossing roll and the third embossing roll includes a mutual spacing that differs from the basic grid of the first embossing roll, and the structural elements are arranged circularly, longitudinally, or helically on the at least one of the second embossing roll and the third embossing roll.

2. A device for satinizing and embossing packaging foils having a part made of paper, comprising:

a first embossing roll; and a second embossing roll, the first embossing roll and the second embossing roll being in rolling contact with one another and the packaging foil being capable of being passed under pressure between the first embossing roll and the second embossing roll in order to produce a satin-finish and a pattern, the first embossing roll having a tooth array arranged in a basic grid and composed of homogenously arranged individual teeth, and the second embossing roll having a surface structure that differs from that of the first embossing roll, wherein:

the second embossing roll has a surface structure comprising structural elements that are arranged individually or in groups but not in the same basic grid as on the first embossing roll, each of the structural elements of the second embossing roll includes individual teeth or a combination of teeth and a continuously formed ridge, at least one of the teeth and the ridge of the second embossing roll includes a mutual spacing that differs from the basic grid of the first embossing roll, and the structural elements arc arranged circularly, longitudinally, or helically on the second embossing roll.

3. A device according to claim 1, wherein the second embossing roll provided with the surface structure has longitudinal ridges that are interrupted by circular structural elements formed of teeth arranged in one, two, or multiple rows.

4. A device according to claim 3, wherein the third embossing roll provided with the surface structure has circumferential ridges.

5. A device according to claim 4, wherein the third embossing roll has longitudinally arranged structural elements that are each formed of individual teeth and are arranged in one, two, or multiple rows.

6. A device according to claim 1, wherein the second and/or third embossing roll provided with the surface structure has helically arranged structural elements that are each formed of individual teeth and are arranged in one, two, or multiple rows.

7. A device according to claim 1, wherein the second embossing roll provided with the surface structure has circumferential structural elements at variable intervals, the structural elements being arranged circularly or helically.

8. A device according to claim 7, wherein the third embossing roll provided with the surface structure has helically or longitudinally arranged structural elements in the form of ridges.

9. A device according to claim 1, wherein the cross-section of the ridge is outwardly tapered and flattened, the dimensions of the ridges and of the grooves therebetween corresponding to the dimensions of the teeth of the first, driven embossing roll, and all teeth engaging in the grooves between the ridges.

10. A device according to claim 1, for embossing marks whose appearance varies according to the viewing angle of the observer and/or the kind and/or the position of the lighting source, wherein the embossing teeth of the first embossing roll which produce the varying marks have another geometrical shape than the teeth that are intended for satinizing.

11. A device according to claim 1, for embossing authentication and identification features, wherein surfaces of embossing teeth and/or locations on a tooth bottom of the first embossing roll are provided with microstructures.

12. A device according to claim 11, wherein the microstructures comprise ridges or grooves arranged in the manner of a grid at intervals of less than a micrometer up to 30 micrometers.

13. A device according to claim 11, wherein the geometrically modified embossing teeth have a smaller height than the remaining teeth.

14. A device according to one of claim 11, wherein the geometrically modified embossing teeth have a different flank or edge shape than the remaining teeth.

15. A device according to claim 2, wherein the second embossing roll provided with the surface structure has longitudinal ridges that are interrupted by circular structural elements formed of teeth arranged in one, two, or multiple rows.

16. A device according to claim 2, wherein the second embossing roll provided with the surface structure has circumferential structural elements at variable intervals, the structural elements being arranged circularly or helically.

17. A device according to claim 2, wherein a cross-section of the ridge is outwardly tapered and flattened, dimensions of ridges and of grooves therebetween corresponding to dimensions of the teeth of the first embossing roll, and all teeth engaging in the grooves between the ridges, the first embossing roll being driven.

18. A device according to claim 2, for embossing marks whose appearance varies according to a viewing angle of an observer and/or a kind and/or a position of a lighting source, wherein embossing teeth of the first embossing roll which produce varying marks have another geometrical shape than the teeth that are intended for satinizing.

19. A device according to claim 2, for embossing authentication and identification features, wherein surfaces of embossing teeth and/or locations on a tooth bottom of the first embossing roll are provided with microstructures.

* * * * *